US009719473B2

(12) United States Patent
Garrison

(10) Patent No.: US 9,719,473 B2
(45) Date of Patent: Aug. 1, 2017

(54) MOTORCYCLE ENGINE WITH DIRECT FUEL INJECTION

(71) Applicant: Midwest Motorcycle Supply Distributors Corp., Pevely, MO (US)

(72) Inventor: John M. Garrison, Columbia, IL (US)

(73) Assignee: MIDWEST MOTORCYCLE SUPPLY DISTRIBUTORS CORP., Pevely, MO (US)

( * ) Notice: Subject to any disclaimer, the term of this patent is extended or adjusted under 35 U.S.C. 154(b) by 0 days.

(21) Appl. No.: 14/728,663

(22) Filed: Jun. 2, 2015

(65) Prior Publication Data

US 2015/0345451 A1 Dec. 3, 2015

Related U.S. Application Data

(60) Provisional application No. 62/006,640, filed on Jun. 2, 2014.

(51) Int. Cl.

| | |
|---|---|
| ***F02M 61/00*** | (2006.01) |
| ***F02M 61/14*** | (2006.01) |
| ***F02B 75/22*** | (2006.01) |
| ***F02B 61/02*** | (2006.01) |
| *F02M 59/02* | (2006.01) |
| *F02M 35/16* | (2006.01) |

(52) U.S. Cl.

CPC ..... *F02M 61/14* (2013.01); *F02B 61/02* (2013.01); *F02B 75/22* (2013.01); *F02M 35/162* (2013.01); *F02M 59/02* (2013.01); *Y10T 29/49234* (2015.01)

(58) Field of Classification Search

CPC .... F02M 61/14; F02M 61/168; F02M 63/027; F02M 59/48; F02M 59/02; F02M 35/162; F02B 75/22; Y10T 29/49234

See application file for complete search history.

(56) References Cited

U.S. PATENT DOCUMENTS

| | | | | |
|---|---|---|---|---|
| 2,758,580 A * | 8/1956 | Balzer | F01M 9/10 | 123/182.1 |
| 2,974,652 A | 3/1961 | Benzinger | | |
| 5,878,703 A * | 3/1999 | Sweeney | F02B 25/14 | 123/184.24 |
| 6,691,661 B2 * | 2/2004 | Lundgreen | F02B 61/02 | 123/184.31 |
| 6,761,151 B2 | 7/2004 | Kojima | | |

(Continued)

*Primary Examiner* — Hieu T Vo
*Assistant Examiner* — Sherman Manley
(74) *Attorney, Agent, or Firm* — Thompson Coburn LLP; Matthew Himich

(57) ABSTRACT

An air cooled V-twin engine comprises first and second cylinders, first and second cylinder heads, first and second fuel injectors, a fuel tank, and first and second fuel pumps. The cylinders and the cylinder heads comprise cooling fins and define first and second combustion chambers. Each of the fuel injectors is attached to a respective one of the cylinder heads in a manner such that they can discharge fuel directly into said combustion chamber. The first fuel pump is operatively connected to the fuel tank and to the second fuel pump in a manner such that the first fuel pump can pump fuel from the fuel tank to the second fuel pump. The second fuel pump is operatively connected to the fuel injectors in a manner such that the second fuel pump can pump fuel to the fuel injectors.

2 Claims, 8 Drawing Sheets

(56) References Cited

U.S. PATENT DOCUMENTS

| | | | | |
|---|---|---|---|---|
| 6,877,491 | B2 * | 4/2005 | Hanawa | F01L 1/022 123/195 C |
| 7,219,657 | B2 * | 5/2007 | Hotta | F02B 31/04 123/184.31 |
| 8,511,273 | B2 * | 8/2013 | Burgess | F01L 1/024 123/195 R |
| 2002/0038651 | A1 * | 4/2002 | Sato | F01P 3/20 123/468 |
| 2007/0169755 | A1 * | 7/2007 | Hanawa | F02M 61/14 123/470 |
| 2008/0230036 | A1 | 9/2008 | Bauman et al. | |
| 2010/0242872 | A1 * | 9/2010 | Sato | F01L 13/0063 123/54.4 |
| 2015/0275743 | A1 * | 10/2015 | Ohmori | F02B 29/0443 123/563 |

* cited by examiner

MOTORCYCLE ENGINE WITH DIRECT FUEL INJECTION

CROSS-REFERENCE TO RELATED APPLICATIONS

This application claims the benefit of provisional Application Ser. No. 62/006,640, filed on Jun. 2, 2014, which is hereby incorporated herein by reference in its entirety.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains to a motorcycle engine comprising direct fuel injection. More particularly, the present invention pertains to an air cooled V-twin engine comprising direct fuel injection.

General Background

The aesthetics of V-twin air cooled motorcycle engines are highly significant. The appearance of such an engine and its components is often important to the marketability of the engine and/or its components. For example, air intake housings are often polished or chrome plated, as are the cooling fins of the cylinders and cylinder heads. As such, it is necessary to hide or camouflage otherwise unattractive engine components. For example, the inventor of the present invention also invented a way to camouflage an exhaust gas recovery system for an air cooled motorcycle engine, which is the subject of pending patent application Ser. No. 13/948,909, filed Jul. 23, 2013. Due in part to the unattractiveness of components associated with gas direct fuel injection (GDFI) components, a reasonable solution to providing a V-twin engine with GDFI has not previously existed.

SUMMARY OF THE INVENTION

The present invention is directed at reducing undesirable emissions generated in V-twin motorcycle engines and to improving the power output of motorcycle engines via GDFI. GDFI eliminates cross-talk between cylinders, which is common in port fuel injected V-twin engines in view of the necessarily short length of the intake manifold that is operatively connected to both heads of the V-twin engine. The present invention is also directed to a GDFI solution that does not appreciably detract from the aesthetics of a V-twin motorcycle engine.

In one aspect of the invention, an air cooled V-twin engine comprises first and second cylinders, first and second cylinder heads, first and second fuel injectors, a fuel tank, and first and second fuel pumps. The first and second cylinders and the first and second cylinder heads comprise cooling fins and define first and second respective combustion chambers. The first and second fuel injectors are attached to the first and second cylinder heads respectively in a manner such that the first and second fuel injectors can discharge fuel directly into the first and second combustion chambers respectively. The first fuel pump is operatively connected to the fuel tank and to the second fuel pump in a manner such that the first fuel pump can pump fuel from the fuel tank and supply fuel to the second fuel pump. The second fuel pump is operatively connected to the first and second fuel injectors in a manner such that the second fuel pump can pump fuel to the first and second fuel injectors.

In another aspect of the invention, an air cooled V-twin engine comprises first and second cylinders, first and second cylinder heads, first and second fuel injectors, first and second rocker boxes, and a fuel pump. The first and second cylinders and the first and second cylinder heads comprise air cooling fins and define first and second combustion chambers respectively. The first and second fuel injectors are attached to the first and second cylinder heads respectively in a manner such that the first and second fuel injectors can discharge fuel directly into the first and second combustion chambers respectively and such that the fuel injectors are concealed by the rocker boxes.

Still another aspect of the invention pertains to a method of converting an air cooled V-twin engine into a direct fuel injection engine. The engine comprises first and second cylinders, first and second cylinder heads, and a cam chest. The first and second cylinders and the first and second cylinder heads comprise air cooling fins and define first and second combustion chambers respectively. The cam chest comprises a cam shaft. The method comprises attaching a high pressure fuel pump to the exterior of the cam chest and operatively to the cam shaft in a manner such that the cam shaft can drive the high pressure fuel pump. The method further comprises inserting first and second fuel injectors through the first and second cylinder heads respectively in a manner such that each of the injectors extends through the respective cylinder head and into the respective combustion chamber. Still further, the method comprises operatively connecting the high pressure fuel pump to the first and second fuel injectors in a manner such that the high pressure fuel pump can supply high pressure fuel to the first and second fuel injectors.

Further features and advantages of the present invention, as well as the operation of the invention, are described in detail below with reference to the accompanying drawings.

Figure 1:
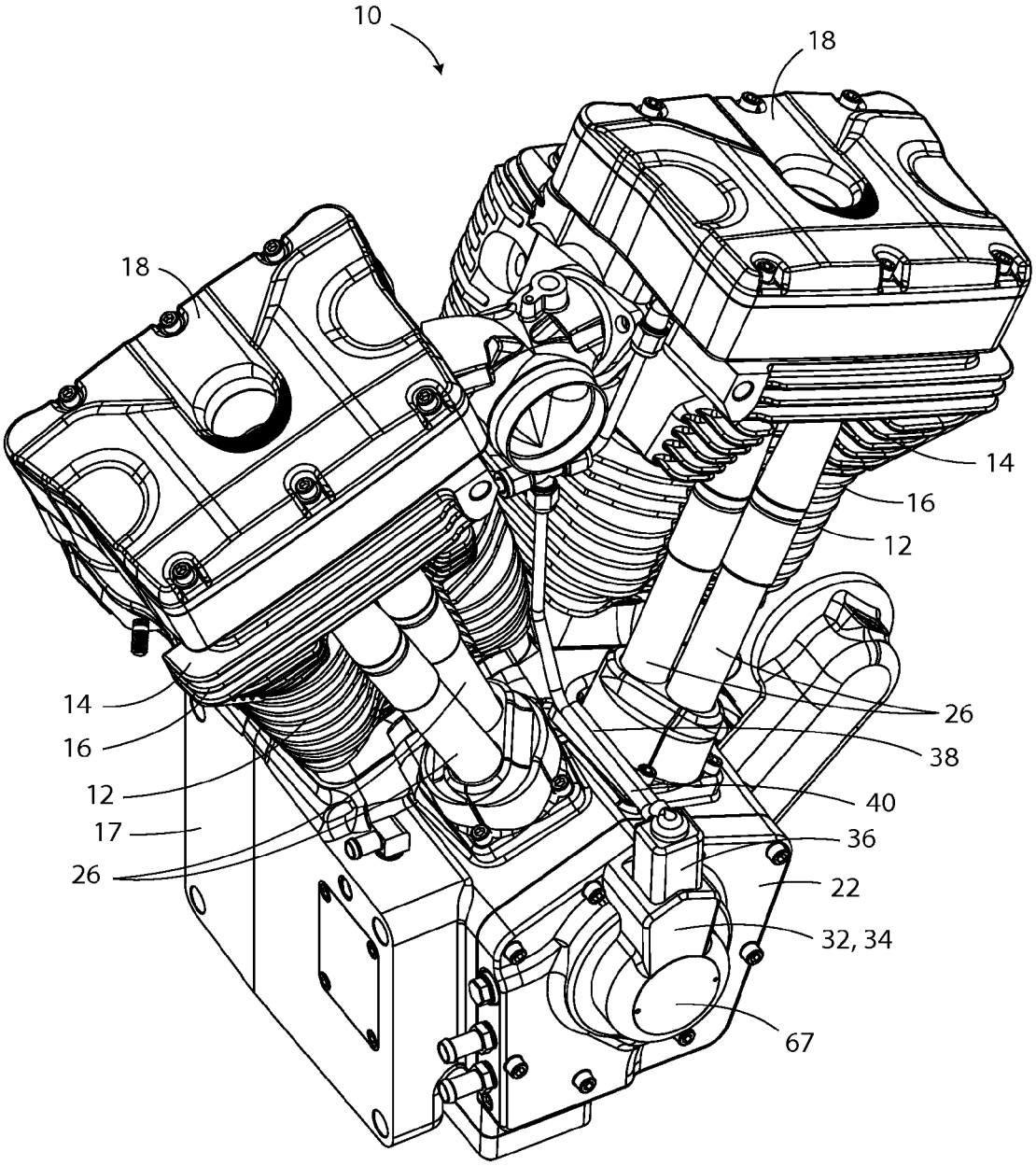
FIG. 1 is a perspective view of an embodiment of the invention (with some components omitted for clarity).
Figure 2:
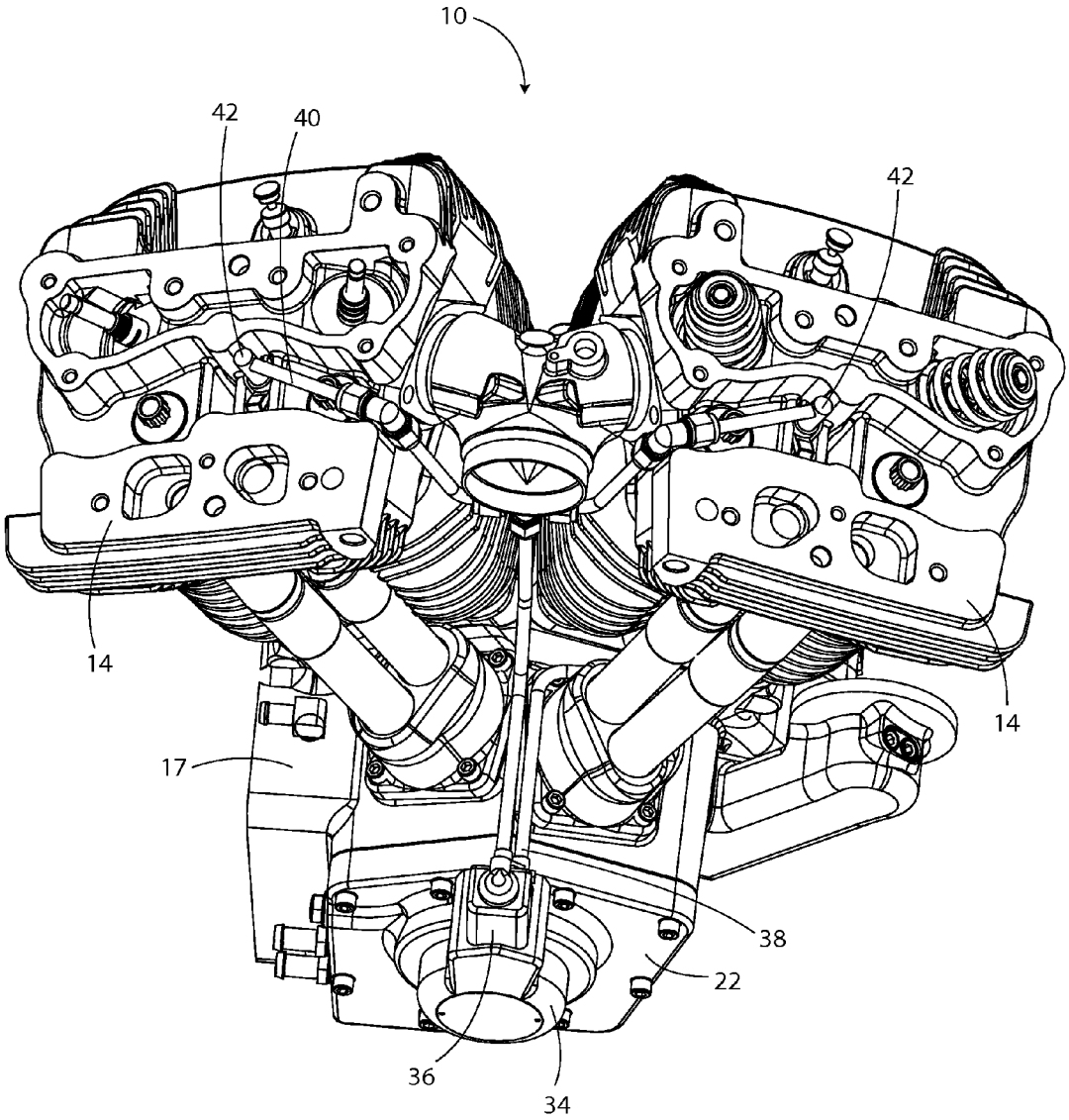
FIG. 2 is a perspective view of the embodiment shown in FIG. 1 with the rocker boxes removed to show the injectors.

Reference numerals in the written specification and in the drawing figures indicate corresponding items.

DETAILED DESCRIPTION

Figure 4:
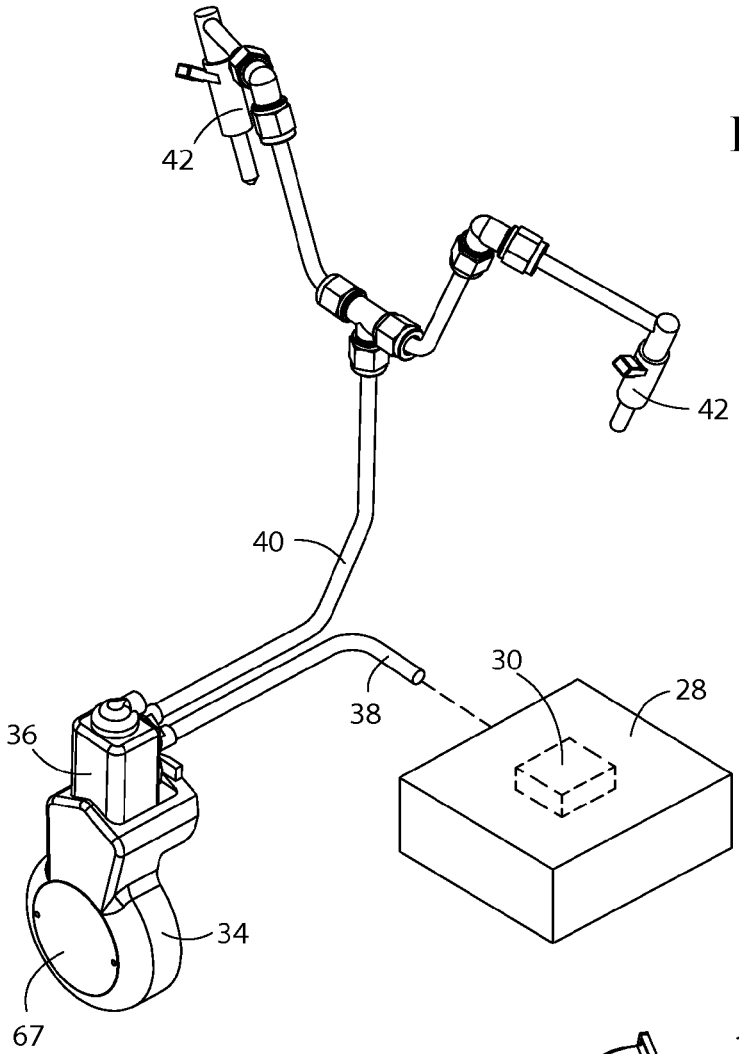
FIG. 4 is a perspective view of the fuel injection assembly.
Figure 3:
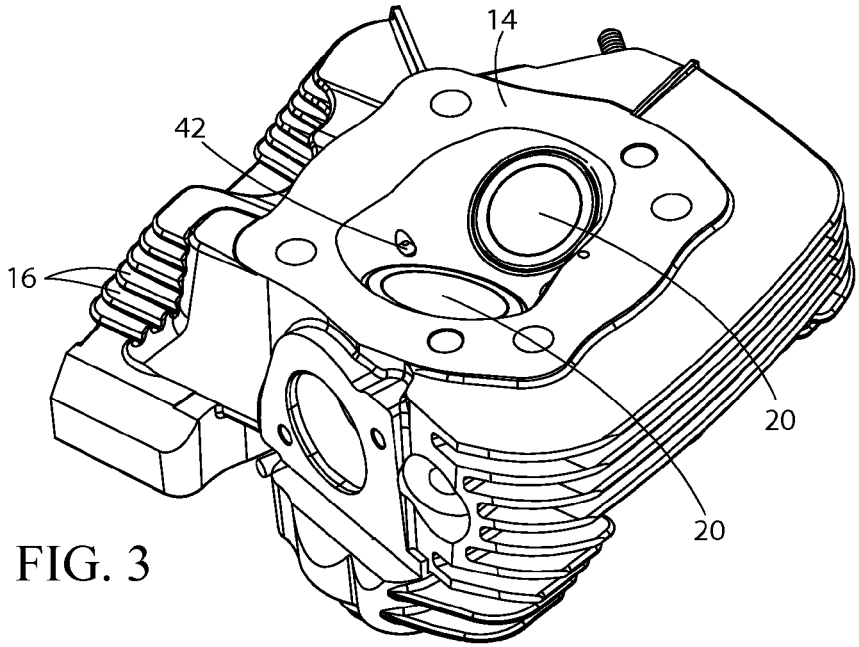
FIG. 3 is a cylinder head in accordance with the invention, which comprises a fuel injector therein.
Figure 5:
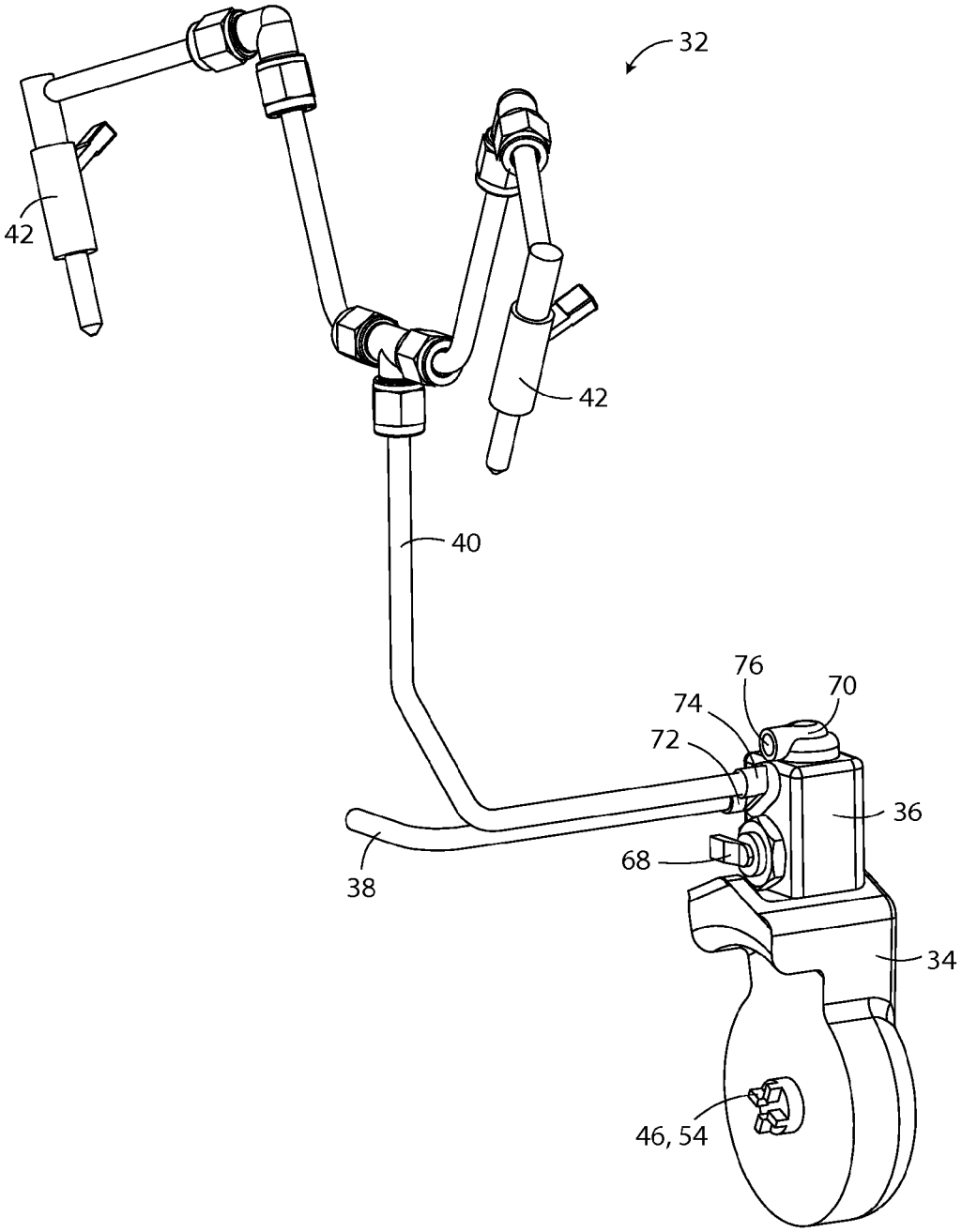
FIG. 5 is another perspective view of the fuel injection assembly.
Figure 10:
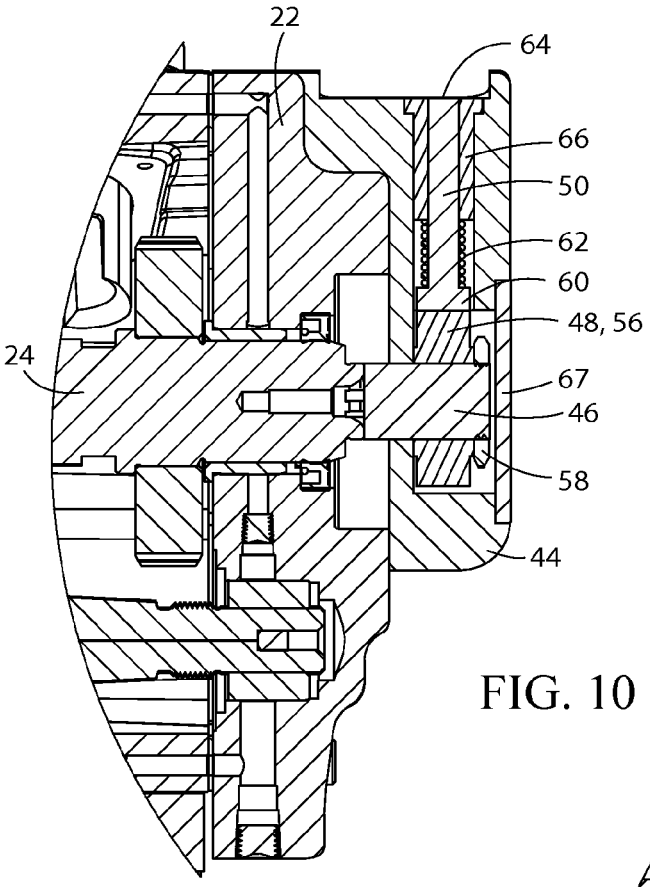
FIG. 10 is a detail cross-sectional view of the cam chest and high pressure pump assembly with the pump piston in its top-dead-center position, and is taken about a plane intersecting the cam shaft and pump piston axes.
Figure 11:
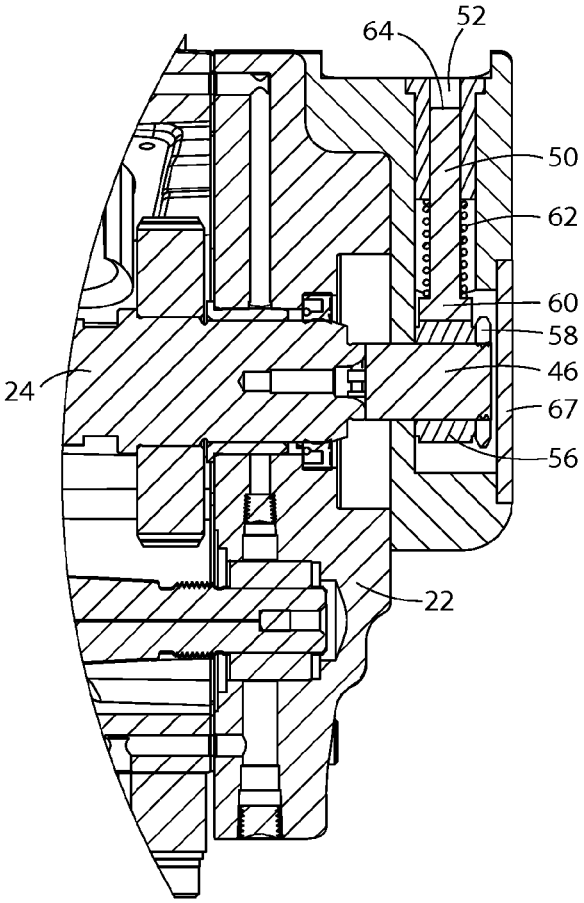
FIG. 11 is a similar detail cross-sectional view of the cam chest and high pressure pump assembly, depicting the pump piston in its bottom-dead-center position.

An engine 10 in accordance with the invention is shown in FIG. 1. The engine comprises a pair of cylinders 12 and cylinder heads 14. The cylinders 12 and heads 14 comprise air cooling fins 16 and are attached to an engine case 17 in a V-style manner. A rocker box 18 is attached to the top of each cylinder head 14 for controlling the operation of the intake and exhaust valves 20 of the cylinder heads. The engine further comprises a cam chest 22, which, as shown in FIGS. 10 and 11, at least partially houses and supports a cam shaft 24 that is driven off of the engine's 10 crank shaft (not shown) and is configured to drive lifting rods (not shown) that pass through lifting rod tubes 26 and open and close the intake and exhaust valves 20 of the cylinders 12. The engine 10 is configured to be installed on a motorcycle in a manner such that the cam shaft 24 is oriented horizontal and side to side. The motorcycle comprises a fuel tank 28 and low pressure fuel pump 30, which are shown schematically in FIG. 4. The low pressure fuel pump 30 is preferably located in or adjacent to the fuel tank 28.

The engine comprises a gas direct fuel injection (GDFI) system 32. The GDFI system 32 comprises a high pressure fuel pump assembly 34 that is attached to the cam chest 22 and is operatively driven by the cam shaft 24. The GDFI system 32 also includes control module 36, a low pressure fuel line 38, a high pressure fuel line 40, and electronically controlled fuel injectors 42. As shown, the GDFI system 32 may be configured to be added to engine 10 to convert the engine from a carbureted or throttle body injected engine into a direct fuel injection engine (i.e., one in which fuel is injected directly into the combustion chambers).

Figure 6:
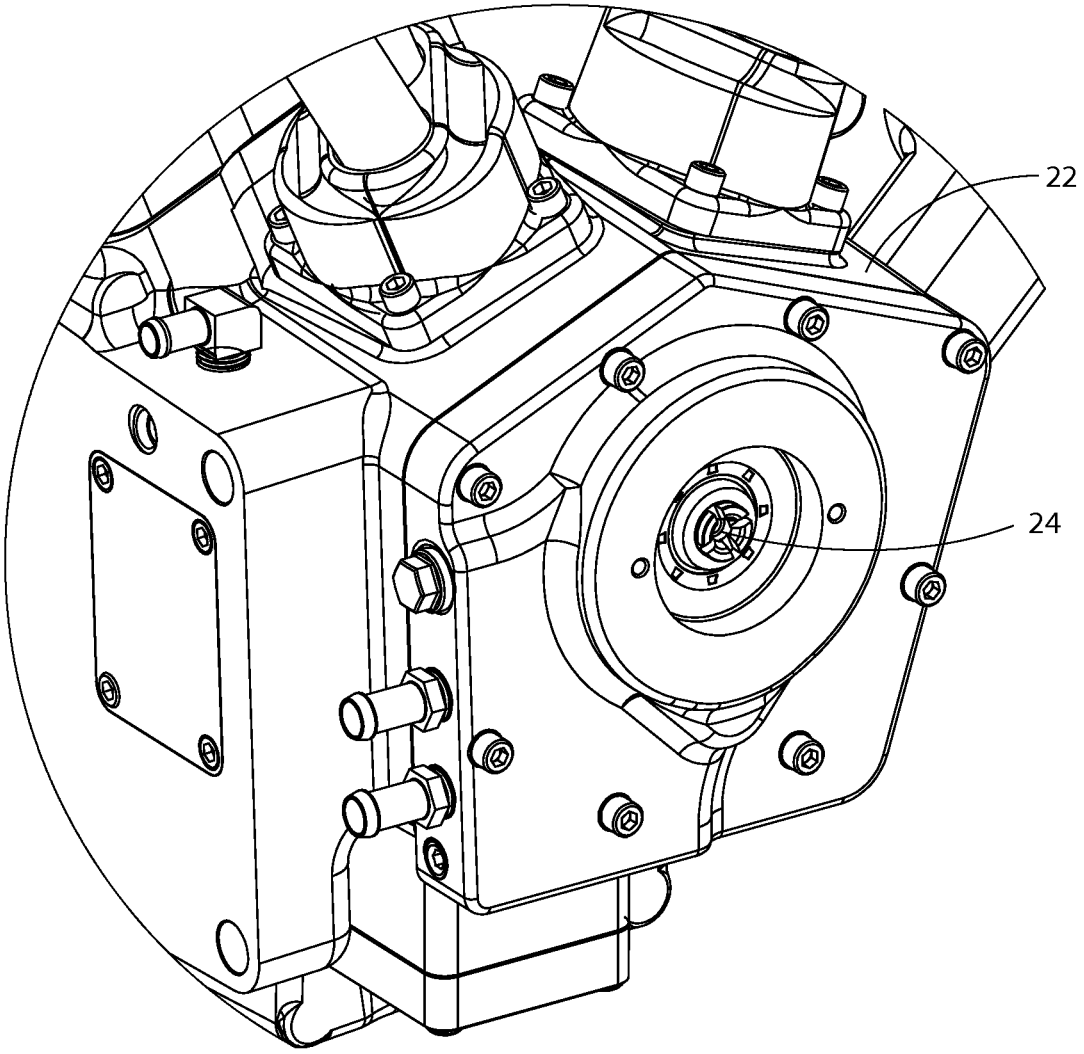
FIG. 6 is a close-up detail view of the cam chest side of a motorcycle engine before a GDFI system in accordance with the invention has been attached thereto.
Figure 7:
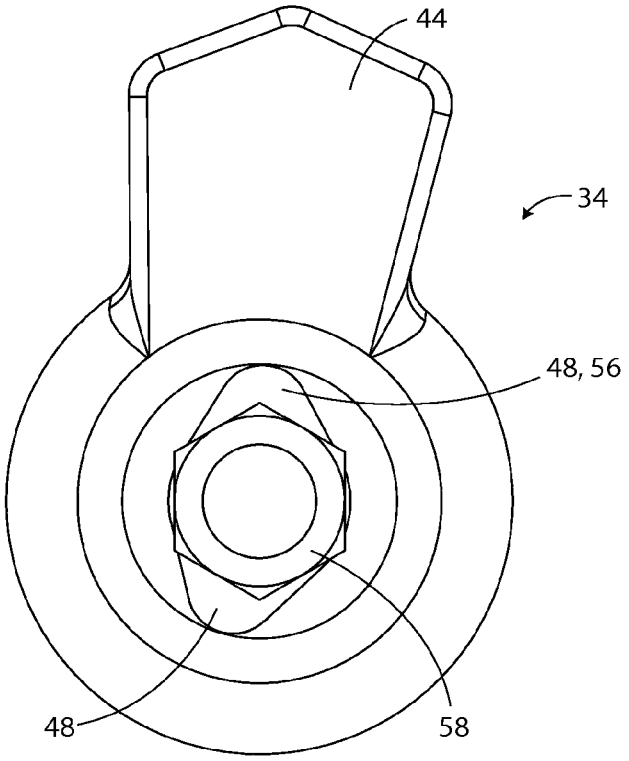
FIG. 7 is a view of the exposed side of a high pressure pump assembly with its cap removed.
Figure 8:
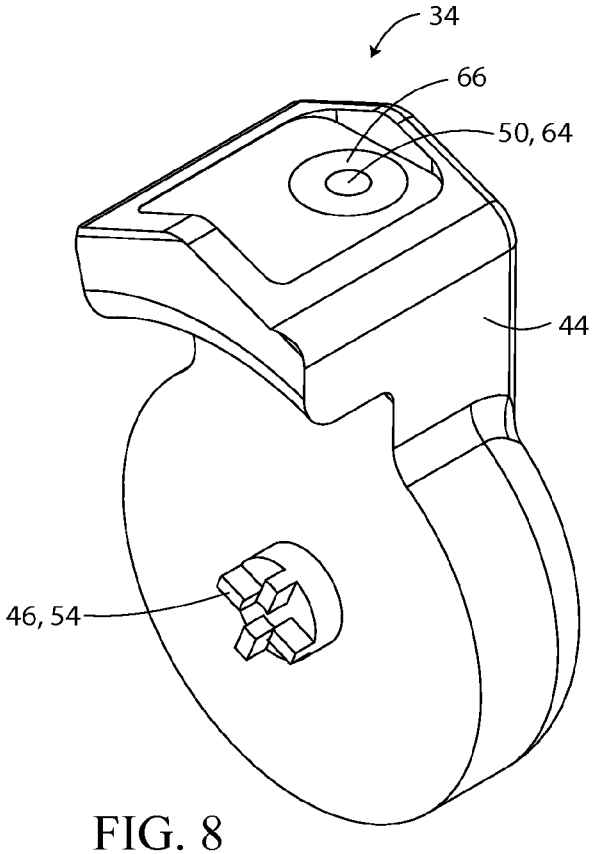
FIG. 8 is a view of the unexposed side of the high pressure pump assembly shown in FIG. 7.
Figure 9:
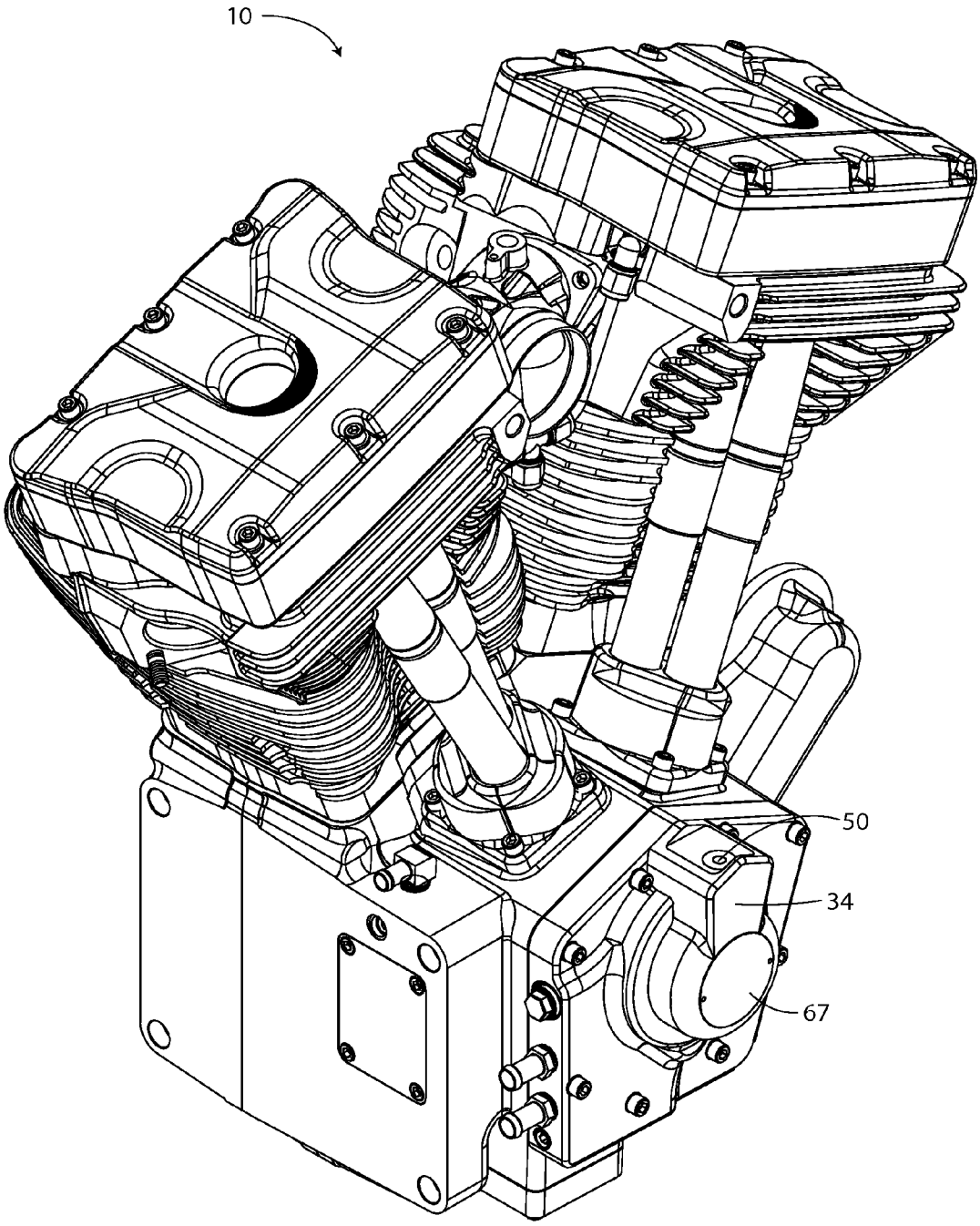
FIG. 9 is a perspective view of the high pressure pump assembly attached to the engine shown in FIG. 6.

The high pressure fuel pump assembly 34 is shown by itself in FIGS. 7 and 8 and preferably comprises a housing 44, a driveshaft 46, cam lobes 48, a pump piston 50, and at least part of a compression chamber 52. The high pressure fuel pump assembly 34 preferably is configured to be attached to the exterior surface of the cam chest 22. If converting the engine 10, the standard cam chest plate (not shown) is first removed to expose the end of the cam shaft 24, as is shown in FIG. 6. The driveshaft 46 of the high pressure fuel pump assembly 34 is aligned with the cam shaft 24 and is directly driven off of the cam shaft via a dog gear connection 54. The cam lobes 48 are preferably formed on a ring 56 that slips over and around the opposite end of the driveshaft 46. A nut 58 secures the cam lobe ring 56 and the cam lobe ring is keyed to the driveshaft 46 for rotation therewith. As shown in FIGS. 10 and 11, the pump piston 50 comprises a cam engagement head 60. A spring 62 biases the pump piston 50 toward the driveshaft 46. As such, as the cam lobes 48 rotate about the driveshaft 46 axis, the pump piston 50 linearly reciprocates and the upper face 64 of the pump piston moves back and forth in the compression chamber 52. The housing 44 of the high pressure fuel pump assembly 34 may comprise a compression chamber member 66 that is housed by the remainder of the housing and that defines the compression chamber 52. The housing 44 preferably also comprises a cap 67 that conceals the cam lobe ring 56.

The control module 36 is mounted to the high pressure fuel pump assembly 34 and comprises one or more check valves (not shown), an electronic fuel pressure regulator 68, a hammer suppression unit 70, a low pressure fuel inlet port 72, and high pressure outlet port 74. The control module 36 functions in a traditional manner to regulate the fuel pressure supplied to the high pressure fuel line 40. More specifically, the electronic fuel pressure regulator 68 controls the pressure generated by the high pressure pump assembly 34 to thereby indirectly control the fuel flow injected into the combustion chambers of the engine 10. The check valve or valves allow the high pressure pump assembly 34 to draw in low pressure fuel from the low pressure fuel line 38 through the low pressure fuel inlet port 72. The hammer suppression unit 70 acts as an accumulator to prevent the fluid hammer effect that would otherwise occur due to the fuel being pumped in pulses, and thereby also reduces the noise caused by the intermittent motion of the fuel. An electronic diagnostic port 76 is provided on the hammer suppression unit 70 to monitor the operation of the GDFI system 32.

The low pressure fuel pump 30 pumps fuel from the fuel tank 28 and delivers it to the low pressure fuel inlet port 72 of the control module 36 at approximately 40 psi. The high pressure fuel pump assembly 34 pressurizes the fuel to around 2,500 psi, which is delivered to the fuel injectors 42 via the high pressure fuel line 40. Each fuel injector 42 is attached to a respective one of the cylinder heads 14 in a manner such that the injector can discharge fuel directly into the combustion chamber of its respective cylinder 12 and cylinder head.

The fuel injection system also comprises an electronic control unit (not shown) that is operatively connected to the fuel injectors 42 and the electronic fuel pressure regulator 68 in a traditional manner for controlling when and how the fuel injectors operate.

By driving the high pressure pump piston 50 directly off cam lobes that rotate about the axis of the cam shaft 24, the height of the high pressure pump assembly 34 and control module 36 relative to the cylinders 12 is minimized, thereby reducing clutter and providing pleasing aesthetics. From the control module 36, the fuel lines 38, 40 extend toward the cylinders 12 horizontally, thereby further providing pleasing aesthetics. The high pressure fuel line 40 then preferably travels up to the cylinder heads 14 in the triangular space between the cylinders 12. This also minimizes the impact of the GDFI system 32 on the aesthetics of the engine 10. Still further, the high pressure fuel line 40 preferably splits and travels to the fuel injectors 42 in the gaps of the cylinder heads 14 located between the valve stems and push rods and beneath the rocker boxes 18. The fuel injectors 42 are also located mainly in such gaps such that they are concealed from view. The air intake filter (not shown) also conceals the vertical portion(s) of the high pressure fuel line 40, thereby making the GDFI system 32 less noticeable.

In other embodiments of the invention, the high pressure fuel pump assembly may be oriented such that it is configured to be driven by linear reciprocation that acts in a direction parallel to the cam shaft. As such, an engine in accordance with the invention may comprise a rocker (not shown) to convert the vertical linear reciprocation of a pump lifter rod into horizontal linear reciprocation that drives the pump. However, it should be appreciated that the second fuel pump could be driven in numerous different manners. For example, the high pressure fuel pump assembly could be operatively connected to the cam shaft or crank shaft via gears rather than directly or via a pump lifter rod.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such and order is inherent.

What is claimed is:

1. An air cooled V-twin engine comprising first and second cylinders, first and second cylinder heads, first and second fuel injectors, first and second rocker boxes, the first and second cylinders and the first and second cylinder heads comprising air cooling fins and defining first and second combustion chambers respectively, the first and second fuel injectors being attached to the first and second cylinder heads respectively in a manner such that the first and second fuel injectors can discharge fuel directly into the first and second combustion chambers respectively and such that the fuel injectors are covered by the rocker boxes.

2. An air cooled V-twin engine in accordance with claim 1 wherein the engine comprises a cam shaft, a high pressure fuel pump, and the at least one fuel pump lobe, the fuel lobe being configured to rotate with the cam shaft and to drive the high pressure fuel pump, the high pressure fuel pump being operatively connected to the first and second fuel injectors in a manner such that the high pressure fuel pump can supply fuel to the first and second fuel injectors.

* * * * *